US008492713B2

(12) United States Patent
Steiner et al.

(10) Patent No.: US 8,492,713 B2
(45) Date of Patent: Jul. 23, 2013

(54) MULTIPOLE ASSEMBLY AND METHOD FOR ITS FABRICATION

(75) Inventors: Urs Steiner, Branford, CT (US); Roy P Moeller, San Leandro, CA (US); Stephen Zanon, Campbell, CA (US)

(73) Assignee: Bruker Daltonics, Inc., Billerica, MA (US)

( * ) Notice: Subject to any disclaimer, the term of this patent is extended or adjusted under 35 U.S.C. 154(b) by 0 days.

(21) Appl. No.: 13/406,651

(22) Filed: Feb. 28, 2012

(65) Prior Publication Data

US 2013/0015341 A1 Jan. 17, 2013

Related U.S. Application Data

(60) Provisional application No. 61/507,838, filed on Jul. 14, 2011.

(51) Int. Cl.

| | |
|---|---|
| ***H01J 49/42*** | (2006.01) |
| ***H01J 49/34*** | (2006.01) |
| ***H01J 49/06*** | (2006.01) |

(52) U.S. Cl.

CPC ..... *H01J 49/4255* (2013.01); *H01J 49/063* (2013.01)

USPC ..... 250/290; 250/281; 250/282; 250/288; 250/291; 250/396 R; 156/60; 156/153; 156/250; 156/305; 156/73.6

(58) Field of Classification Search

CPC .... H01J 49/04; H01J 49/24; H01J 49/42; H01J 49/063; H01J 49/068; H01J 49/423; H01J 49/4215

USPC ..... 250/290, 281, 282, 288, 293, 292, 250/393 R; 151/60, 153, 250, 281, 294, 151/305, 73.6, 91

See application file for complete search history.

(56) References Cited

U.S. PATENT DOCUMENTS

| | | | | |
|---|---|---|---|---|
| 3,410,997 | A * | 11/1968 | Brubaker | 250/290 |
| 4,032,782 | A * | 6/1977 | Smith et al. | 250/292 |
| 4,990,777 | A * | 2/1991 | Hurst et al. | 250/292 |
| 5,298,745 | A * | 3/1994 | Kernan et al. | 250/292 |
| 5,525,084 | A * | 6/1996 | Broadbent et al. | 445/49 |
| 6,926,783 | B2 * | 8/2005 | Loucks, Jr. | 156/73.6 |
| 7,423,262 | B2 * | 9/2008 | Mordehai et al. | 250/292 |
| 2005/0224711 | A1 * | 10/2005 | Loucks, Jr. | 250/292 |
| 2006/0102835 | A1 * | 5/2006 | Laser | 250/282 |
| 2010/0276063 | A1 * | 11/2010 | Bui | 156/91 |

(Continued)

FOREIGN PATENT DOCUMENTS

| | | | |
|---|---|---|---|
| CN | 102779797 | A1 | 11/2012 |
| GB | 2138201 | A1 | 10/1984 |
| JP | 2003004572 | A1 | 1/2003 |

*Primary Examiner* — David A Vanore
(74) *Attorney, Agent, or Firm* — Robic, LLP

(57) ABSTRACT

A multipole rod assembly, such as used as mass analyzer, is fabricated using rods adhesively attached to shoes, which are then attached to isolation rings. A fixture is used in conjunction with precision-made spacers to precisely assemble the ion mass analyzer. The rods and shoes can be made of metal, while the isolation rings are preferably made of insulator, such as ceramic. The shoes and isolation rings need not be made to high precision, as the spacer ensures high accuracy in alignment and symmetry of the rods. Consequently, the rods are the only precision machined parts in the ion mass analyzer assembly.

38 Claims, 9 Drawing Sheets

U.S. PATENT DOCUMENTS

2011/0240849 A1* 10/2011 Wright ..... 250/288
2011/0240850 A1* 10/2011 Wright et al. ..... 250/288
2013/0015341 A1* 1/2013 Steiner et al. ..... 250/281
2013/0015347 A1* 1/2013 Steiner ..... 250/288

* cited by examiner

MULTIPOLE ASSEMBLY AND METHOD FOR ITS FABRICATION

BACKGROUND

This application is in the field of multipole rod assemblies such as used in mass spectrometers and, more specifically, relates to a mass analyzing spectrometers and methods for fabricating multipole mass analyzing spectrometers. Various mass spectrometers are known in the art. An example of a prior art multipole mass spectrometer is illustrated in FIG. 1. For convenience of description, the mass spectrometer example of FIG. 1 is specific to a quadrupole mass analyzer, however embodiments of the invention may be used in other types of multipoles, for instance, hexapoles, octopoles, etc. In the mass spectrometer of FIG. 1, the sample molecules are injected by injector 105 into an ionization chamber 110, which ionizes the molecules, thereby acting as an ion source 110. Ions from the ion source 110 are focused and transferred to the mass analyzer 125 via ion guide 115, which is driven by voltage generator 120.

As shown in FIG. 1, four conductive rods, constituting the quadrupole mass analyzer 125, are arranged in two pairs, each pair receiving the same DC+RF signal, denoted as U+V*cos (w*t), wherein U is the magnitude of the DC voltage while V is the magnitude of the RF signal. One pair of rods receives a positive DC signal at zero phase, while the other receives a negative DC signal at a 180 degrees phase shift (−[U+V*cos (w*t)]), thereby acting as a band pass and separating the ions according to their mass to charge ratio, generally denoted as m/z. This relationship is illustrated in FIG. 2, wherein the shaded area denotes the band-pass wherein only ions having a mass to charge ratio (m/z) within the shaded area may pass the mass analyzer. The width of the band pass is controlled by the signal applied to the rods, such that the narrower the band pass is, the higher the resolution of the mass spectrometer.

By scanning the magnitude of U and V, one can over time allow species of different mass to charge ratio to pass through the spectrometer, thereby obtaining a spectrum of the ion species within the sample material. Generally, during the scanning the ratio UN is kept constant so as to maintain the same band pass. The ions exiting the mass analyzer 125 are detected by detector 145. As shown, controller 140 controls the power applied to the focusing optics and the mass analyzer 125.

In spectrometers, such as the mass spectrometer described above, ions of the proper m/z ratio must be kept at the center of the mass analyzer. This confinement is controlled by the electric field generated by the rods (poles) when they are energized. Therefore, the rods must be accurately manufactured and accurately positioned with respect to each other. That is, in order to maintain a proper field that confines ions to the center of the mass analyzer, a high level of symmetry must be maintained in the spatial positioning of the rods.

The high precision required in manufacturing and assembling the various parts of the mass analyzer have led to attempts aimed at achieving the precision and symmetry requirements, while reducing manufacturing tolerances and costs. The rod spacing precision that is generally aimed at during manufacturing of a typical quadrupole rod assembly is in the order of five micrometers or lower. According to some proposals the mass spectrometer is fabricated in two parts which are then mated to each other. However, such a proposal requires that the two halves be precisely machined so that after assembly they maintain symmetry among all of the rods about the ion transfer axis. According to other proposals, the rods are attached to a mandrel for alignment and then adhered to insulators. Once cured, the mandrel is removed. However, once the adhesive cures, it is rather difficult to remove the mandrel, often requiring lubricants and cooling of the mandrel to cause thermal contraction of the mandrel. This process may also damage or cause misalignment of the rods. Further information concerning the state of the art can be obtained from, for example, U.S. patent publications U.S. Pat. No. 6,926,783 and 2006/0102835.

The U.S. Pat. No. 4,990,777 to Hurst et al. discloses a pole rod assembly where metallic rods are, in a radial direction, spot welded to L-shaped brackets. The brackets are, in an axial direction, spot welded on a flat lateral face to a metallic ring which serves to provide operating voltages to a subset of rods via the intermediate brackets. The metallic ring used for distributing the operating voltages among the subset of rods is glued, likewise in an axial direction, on a flat lateral face to a ceramic holder ring.

In view of the prior art, however, there is still a need for methods for easy and cost effective fabrication of highly precise rod assemblies such as those used as mass analyzers.

SUMMARY

The following summary is included in order to provide a basic understanding of some aspects and features of the disclosure. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

Generally, the invention relates to a multipole assembly comprising a plurality of conductive rods, a plurality of shoes, each shoe adhesively attached, such as by means of epoxy resin, on one of its edges to a corresponding rod, and a plurality of isolation rings, each isolation ring attached on at least one of its sides to a subset of the plurality of shoes.

In various embodiments the shoes are directly adhesively attached to the isolation rings. Shoes may be attached to the isolation rings on both faces thereof at essentially a same circumferential position in order to reduce material distortions due to thermal stress.

In further embodiments the edges of the shoes comprise a slot for taking up excess adhesive.

In some embodiments each of the rods comprises a plurality of roughened areas, such as laser scribed areas, corresponding to locations where the shoes are attached to the rod.

In various embodiments, the shoes are disk-shaped and comprise an arcuate cut of a diameter similar to a diameter of the rods. The shape of a disk provides two extensive side faces at which the shoes may contact and be reliably attached to a side face of the isolation rings. The disk-shape also provides little extension of the shoes in an axial direction simplifying the handling of the assembly.

In various embodiments the arcuate cut may have a textured surface, such as sand blasted surface, laser scribed surface, serrated surface, ribbed surface, and/or ridged surface. Treating a surface intended for adhesive bonding in order to obtain better adhesion properties is known in the prior art. The patent application U.S. 2010/0276063 A1 to Bui, for instance, which is herewith incorporated by reference in its entirety, describes how, in an assembly step, pole rods are glued with a flat outer peripheral surface to a likewise flat inner peripheral surface of a holder in a radial direction. Prior to application of the glue, the bond surfaces are roughened or structured as to improve the adhesion capability and strengthen the bond.

In further embodiments the shoes and/or the isolation rings comprise alignment notches which may favorably interact with alignment pins attached to components of a fixture that holds the conductive rods in place during assembly.

In some embodiments the isolation rings comprise an arcuate cut, at the inner periphery, of a radius larger than a radius of the rods which provides sufficient space for the positioning of rods and isolation rings relative to one another during assembly. The specific design of the assembly process dispenses with the need to keep the distance between rod contour and inner periphery of the isolation ring to high precision.

In preferred embodiments the plurality of rods comprises n rods, the plurality of isolation rings comprises m isolation rings, and the plurality of shoes comprises n times m, n*m, shoes. The plurality of rods can constitute a quadrupole with n equaling four. For such an arrangement m equaling three has been found to be an adequate number. The plurality of shoes would then comprise twelve shoes. However, m can generally be chosen freely according to the requirements of the assembly.

In various embodiments the conductive rods define an ion transfer axis and an inner radius, $R_0$, and materials for the conductive rods, the shoes and the isolation rings are chosen such that the inner radius is essentially invariant with change in temperature. The aforementioned notion is known in the prior art. The U.S. Pat. No. 4,032,782 to Smith et al., for instance, the content of which is herewith incorporated by reference in its entirety, discloses a method of selecting a material for the construction of a multipole mass filter that retains the inner width parameter $R_0$ invariant with change in temperature. For that purpose, the coefficients of thermal expansion of the material of the multipole rods and the material(s) of a mounting structure to which the rods are directly attached in a radial direction are chosen so that a constant ratio of the two is provided. This ratio is essentially determined by the geometrical dimensions of the rods and mounting structure.

In some embodiments, the conductive rods define an ion transfer axis and an inner radius, $R_0$, and a radial distance of a point of attachment between shoes and isolation ring from the ion transfer axis is selected such that, in view of thermal expansion properties of materials for the conductive rods, shoes and isolation rings, the inner radius is essentially invariant with change in temperature.

The invention, furthermore, relates to a method for fabricating a multipole assembly, comprising the steps of inserting a plurality of conductive rods into a fixture, inserting at least one precision-made spacer in between the plurality of rods, urging the rods against the spacers to obtain precise alignment of the rods, adhesively attaching a plurality of shoes onto the rods, attaching a plurality of isolation rings—preferably directly—onto the shoes, and after the plurality of shoes are adhesively attached to the rods and the plurality of isolation rings are attached to the shoes, removing the spacers and releasing the rods from the fixture. The order in which the method steps are presented above does not necessarily reflect the order in which the method steps are to be carried out. For example, attaching the isolating rings onto the shoes may be conducted prior to or after attaching the shoes onto the rods. In some embodiments it is also possible to execute two or more method steps, such as creating the adhesive bonds, simultaneously. Such permutations in the order of method steps, when practicable, shall therefore also be included in the scope of the invention.

In various embodiments a plurality of areas on each of the rods is roughened prior to their attachment, the plurality of areas corresponding to the location of bonding of the shoes. Likewise, the edges of the plurality of shoes, at which the shoes are to be attached to the rods, may be surface treated as to improve adhesion properties. Preferably, surface treating comprises sand blasting the surface, laser scribing the surface, or cutting the surface to generate serrated surface, ribbed surface, or ridged surface.

The invention also relates to a spacer for fabricating a multipole assembly having a plurality of rods, the spacer comprising arms extending from a cross-point with two arms extending along a rotational axis, the spacer also comprising nesting areas between adjacent arms with effective nesting space for receiving and aligning the rods, wherein the cross section of the arms in the nesting areas is configured such that by rotating the spacer around the rotational axis the effective nesting space is increased.

The effective nesting space essentially is a spacing between two arms in a plane perpendicular to a rod axis during assembly (that usually is also a plane of extension of the arms). In other words, it essentially represents a spatial restriction a rod experiences from two adjacent arms in a plane perpendicular to the axis of the rod during assembly. As will be apparent from the detailed description of preferred embodiments below, by choosing a specific configuration of the cross section of the arms in the nesting areas this spacing or spatial restriction can be favorably changed by a rotation of the spacer in respect of the axis of the rod. To achieve such favorable rotational properties the cross section of the arms may be essentially rectangular or square with dimples in the nesting areas, for example.

In some embodiments each arm comprises a section having an S-shaped cross-section with the S-shaped cross section on one side of the rotational axis being oriented opposite that of the S-shape cross section on the other side of the rotational axis.

In various embodiments, the nesting areas have a shape generally adapted to a diameter of the rods in order to provide optimal alignment capability of the rods.

In some embodiments, the nesting areas comprise a flattened surface in a region of contact between rod and arm in order to provide a more stable resting surface of finite dimension during assembly.

In preferred embodiments, the spacer is made of tungsten carbide or some other suitable high strength material.

The invention, moreover, relates to a method for fabricating a multipole assembly, comprising the steps of inserting a plurality of conductive rods into a fixture, inserting at least one precision-made spacer in between the plurality of rods, the spacer having arms a cross section of which determines an effective width which essentially defines a spacing between two adjacent conductive rods, urging the rods against the spacer to obtain precise alignment of the rods, attaching a plurality of isolation rings onto the rods, removing the spacer by means of a rotational motion along a rotational axis running through spacings between the rods, thereby essentially reducing the effective width of the arms and disengaging the spacer from the rods, and releasing the rods from the fixture. As before, the order in which the method steps are presented here is not to be construed restrictive. Permutations of the method steps, or simultaneous execution of selected method steps, may apply when practicable.

Generally, it is favorable to use at least two precision-made spacers in the aforementioned method in order to establish proper rod parallelism during assembling. The use of three precision-made spacers, according to some embodiments, would even further improve the stability of the alignment during assembling.

The effective width is complementary to the effective nesting space mentioned before in the sense that if the effective nesting space increases the effective width declines correspondingly. The effective width can be defined essentially as a dimension of the arms in a plane perpendicular to a rod axis during assembly. The frame of reference in relation to which the effective width is defined is therefore essentially determined by the rods during assembly. Providing a suitable cross sectional contour of the arms, for instance, with indentations or dimples ("S-shape"), the effective width (the width a rod "sees") may be altered by a mere rotation of the spacer, thus, reducing any surface modification in the places where the arms and the rods contact during alignment.

In another aspect the invention relates to a fixture for fabricating a multipole assembly having a plurality of conductive rods. The fixture comprises a support, and a plurality of isolation ring holders attached to the support, the isolation ring holders having recesses, preferably in a shape of pockets, for receiving spacers which assist in the alignment of the rods, and each holder having a plurality of, preferably spring-loaded, plungers for urging the rods against the spacers during assembly of the rods.

In various embodiments, the support comprises a base, and a tower that is either attached to or made integrally with the base. In this manner, a standalone fixture can be provided that may be located on a workbench, for example.

In preferred embodiments the holders are slidably attached to the support via a sliding track providing high flexibility for the positioning of the isolation rings as well as easing the mounting and removal of the conductive rods and the assembled multipole, respectively.

In further embodiments the holders have alignment pins for aligning isolation rings and shoes during assembly of the rods. The alignment pins may be attached to ends of the plungers and may engage with alignment notches located at the outer periphery of shoes and/or isolation rings.

In favorable embodiments, a number of plungers on each holder corresponds to a number of rods to be assembled, such as four, six, eight et cetera.

In further embodiments the holders comprise two half rings, preferably positioned on one side thereof, the half rings having two machined steps for supporting an isolation ring and being held in place by removable pins.

Disclosed embodiments enable simplified fabrication of multipole rod assemblies such as mass analyzers, which provides higher accuracy of spacing and alignment of the electrodes forming the analyzer. According to embodiments of the invention, the mass analyzer is fabricated by assembling the rods in a fixture. A plurality of temporary spacers is inserted between the rods to provide precise alignment of the rods. The rods are adhered to ring isolations via a plurality of shoes. Once the adhesive cures, the spacers are removed and the assembly is removed from the fixture. Establishing adhesive bonds imparts significantly less thermal load to the material of rods or shoes than, for example, a welding process as suggested by the prior art. Generally, adhesive bonding between rods and shoes, and also between shoes and isolation rings, prevents electrically conductive contact between these elements and may thus provide some kind of electrical insulation, at least to some extent. Such electrical insulation favorably provides for minimum capacitive loading of the rod assembly. Since, in operation, these interfaces are basically not passed by electrical currents, structural wear-off of the material is also reduced.

According to described embodiments, the isolation rings and the shoes need not be fabricated to high tolerance, as the spacers provide the alignment accuracy. Since the spacers may be reused for fabricating many mass analyzers, the cost of fabricating highly accurate spacers is spread among many mass analyzers. The use of the fixture together with the spacers, isolation rings and shoes, make assembly of the multipole mass analyzer rather easy and fast, while ensuring accurate alignment and symmetry.

BRIEF DESCRIPTION OF THE DRAWINGS

Other aspects and features of the invention will be apparent from the detailed description, which is made with reference to the following drawings. It should be appreciated that the detailed description and the drawings provide various non-limiting examples of various embodiments of the invention, which is defined by the appended claims.

DETAILED DESCRIPTION

While the invention has been shown and described with reference to a number of embodiments thereof, it will be recognized by those skilled in the art that various changes in form and detail may be made herein without departing from the spirit and scope of the invention as defined by the appended claims.

Embodiments of the invention provide multipole rod assemblies such as ion mass analyzers that are easier and cost effective to fabricate, yet maintain high alignment and symmetry precision. The embodiment illustrated and described is for a quadrupole, but it should be appreciated that it is equally applicable for fabricating other multipole analyzers, such as hexapole, octopole, etc. The mass analyzer constructed according to embodiments of the invention may be used in any mass spectrometer type where the ions are separated according to their mass/charge ratio.

Figure 1:
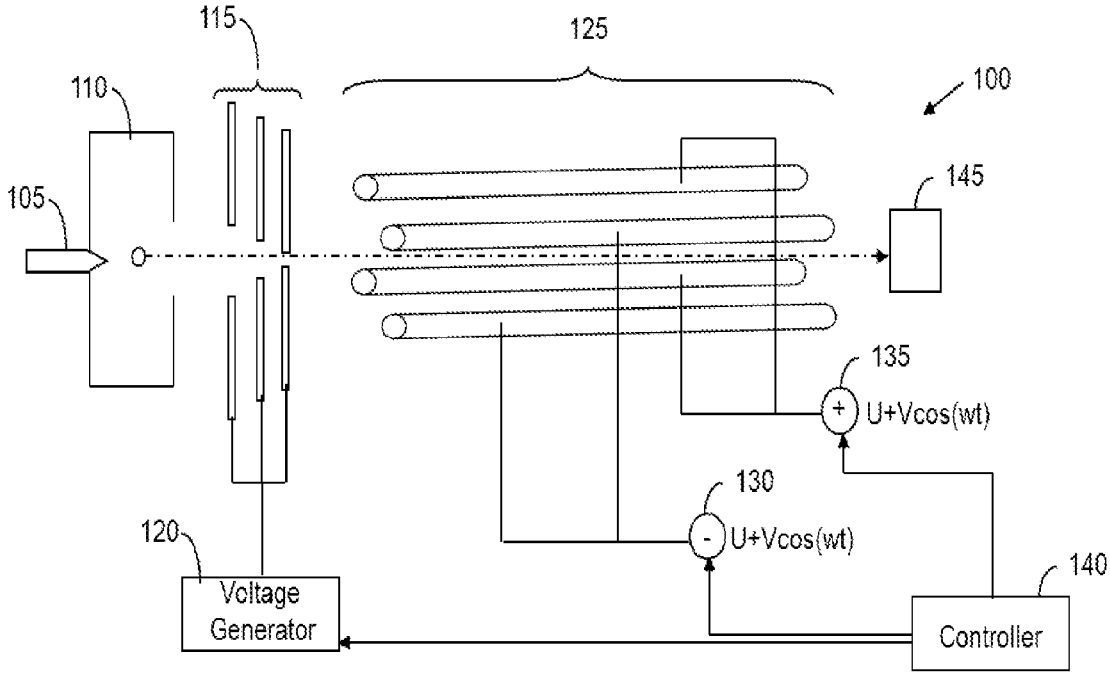
FIG. 1 (Prior Art)
FIG. 1 is a schematic of a conventional quadrupole mass spectrometer which may be adapted for implementing an embodiment of the invention.
Figure 2:
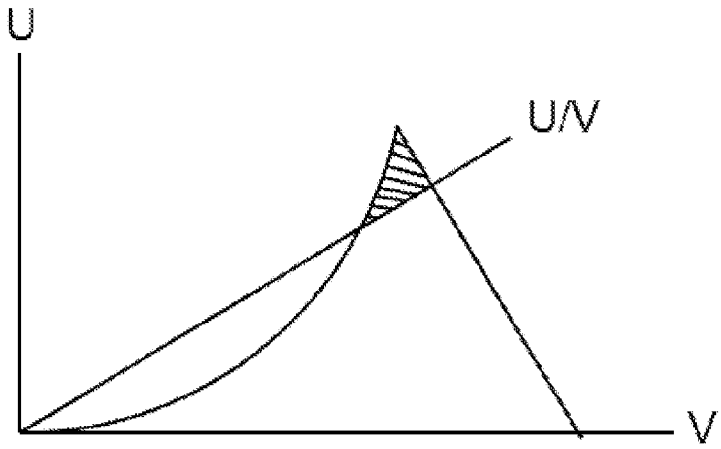
FIG. 2 (Prior Art)
FIG. 2 is a plot illustrating the ion separation action of the quadrupole mass spectrometer of FIG. 1.
Figure 3A:
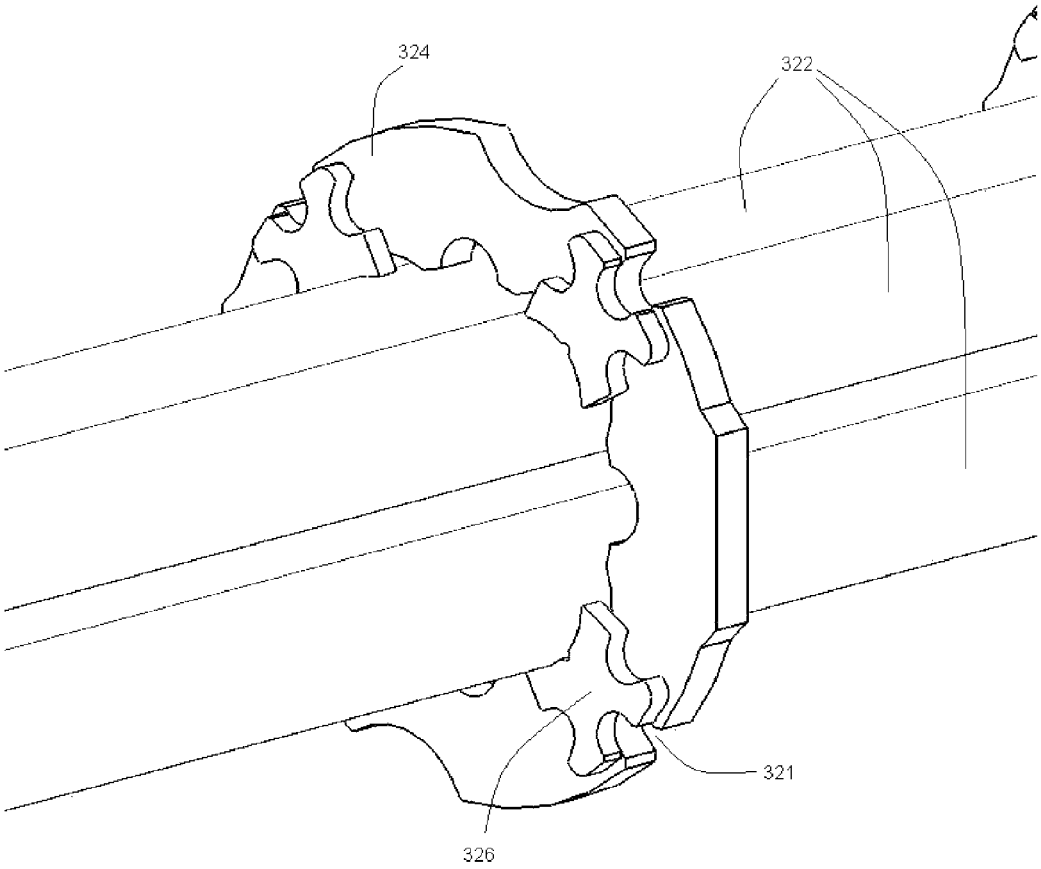
FIGS. 3A-3B are schematics illustrating ion mass analyzers according to an embodiment of the invention.
Figure 3B:
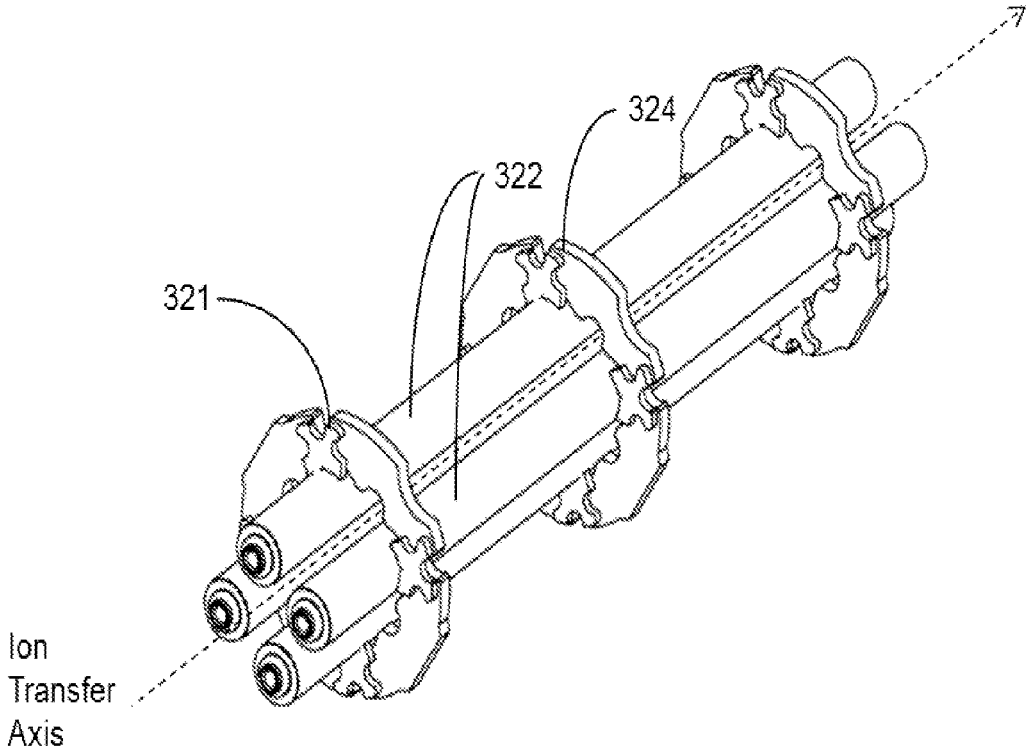

The details of an embodiment of the invention will now be described with reference to the drawings. In FIGS. 3A-3B, four rods 322 are positioned in precise alignment and symmetry about the ion transfer axis for forming the quadrupole. The rods are conductive and can be made from, for instance, stainless steel. Rods 322 are adhered to isolation rings 324 via shoes 326. That is, the rods are not adhered directly to the isolation rings, rather the shoes are adhered to the isolation rings on one surface thereof, and to the rods on an edge thereof, as will be explained more fully below. In this embodiment, the isolation rings 324 may be made of, for example, ceramic such as alumina, while the shoes may be made of, for example, stainless steel.

As shown in the example of FIGS. 3A-3B, three isolation rings 324 are provided along the length of the quadrupole. The number of isolation rings may vary, for instance, two, four, six, etc. However, in this example the use of three isolation rings was found to be well suited for providing enhanced dimensional stability and robustness. Also, since only three isolation rings are used, and since the isolation rings are rather thin, this provides an open design that maximizes gas conductance. A further advantage of thin rings is that less costly cutting techniques can be employed to form the rings (by Laser or water jet cutting, for example).

Since the rods are not adhered directly to the isolation rings, the precision requirement for fabricating the isolation rings 324 is relaxed somewhat for a reduced cost and ease of fabrication. Each of the isolation rings supports the rods by having a plurality of shoes 326 attached to one side of the isolation rings. Of course, one may utilize shoes on both sides of the isolation rings. By such a symmetric arrangement of the shoes thermal stress on the isolation ring due to varying temperature conditions, causing different degrees of thermal expansion at the point of attachment when shoes and isolation rings are made of different materials, can be reduced. However, in this example the provision of shoes on only one side was determined to be adequate. Also, each of the isolation rings 324 has a plurality of alignment slots or notches 321, which, while not necessary, assist in alignment of the isolation rings during assembly, as will be described more fully below.

In the particular example of FIGS. 3A to 3B, the number of shoes 326 attached to each isolation ring 324 equals the number of rods 322. That is, each shoe 326 attaches on one of its edges to one rod 322 and on one of its sides to one isolation ring 324. Also, as shown in FIGS. 3A-3B, the shoes are attached to the rods in a non-critical area—external to the central critical field area of the multipole thus ensuring internal field uniformity along the axis.

Figure 4A:
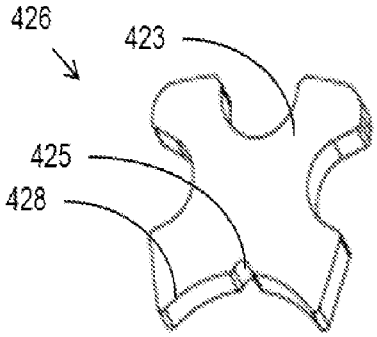
FIGS. 4A-4C illustrate shoes according to embodiments of the invention.
Figure 4B:
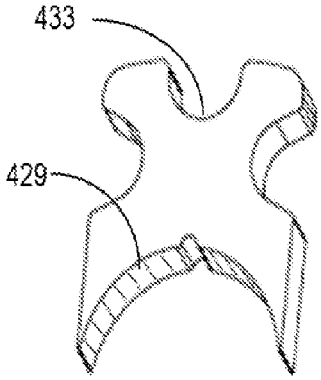
Figure 4C:
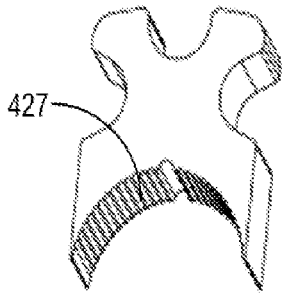

FIGS. 4A-4C illustrate different shoes according to embodiments of the invention. As shown, the shoes have an arcuate edge (428 in FIG. 4A), which is formed as an arc shape having a radius similar to the radius of the rods. The flat surface, 423, is shaped for adhering to the isolation ring and has an alignment slot or notch 433, in this example matching the alignment slot 321 of the isolation ring. A slot 425 is also provided on the arcuate edge 428, so as to take up excess adhesive.

In FIG. 4B the arcuate edge 429 has been treated (indicated by the hatching), for example, sand blasted or laser scribed so as to form a rough surface for improved adhesion. In FIG. 4C the arcuate edge has been formed with ridges or serrations or ribs, which may or may not be treated as in FIG. 4B. The ridges or serrations or ribs also improve adhesion.

In the embodiment of FIG. 4B the arc is longer than that of FIG. 4A, thus forming a larger part of a circle to thereby cover a larger circumference of the rod which also improves stability of the bond.

Figure 5:
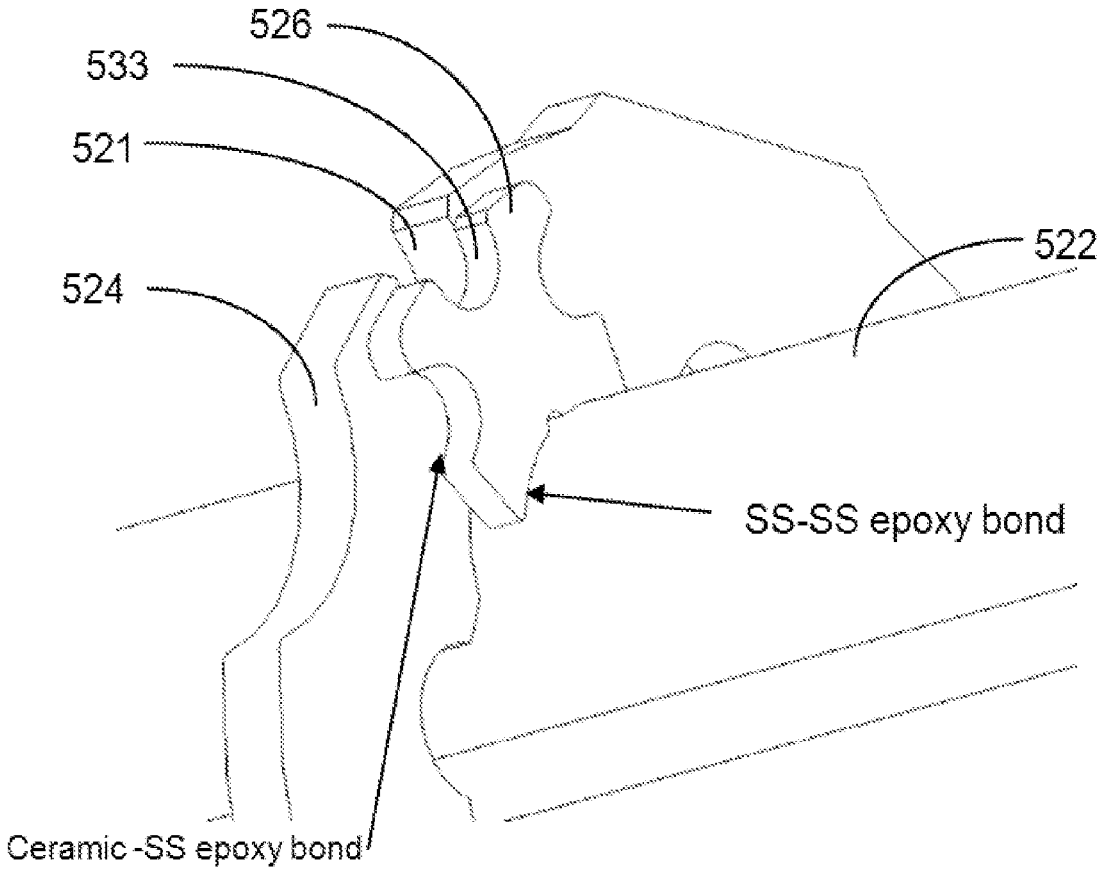
FIG. 5 is a close-up view showing one shoe adhered on its arcuate edge to a rod and on its flat surface to an isolation ring, according to an embodiment of the invention.

FIG. 5 is a close-up view showing one shoe 526 adhered on its arcuate edge to a rod 522 and on its flat surface to an isolation ring 524. The shoe 526 is adhered to the rod 522, in this example, using an epoxy for adhering stainless steel to stainless steel, while the flat surface of the shoe 526 is adhered to the insulating ring 524 using an epoxy for adhering stainless steel to ceramic. In favorable embodiments the adhesive is a two component adhesive having a long working time, that is, settles rather slowly. It preferably features a low volatility in order to keep a potentially disturbing gas load due to degassing in an evacuated environment of the multipole assembly in a mass spectrometer low. It should also have a low viscosity to prevent sliding motions of the rods relative to one another during alignment and/or curing. In further embodiments it also has a high glass transition temperature and low curing temperature in order to keep the thermal load on the materials of the rod assembly low during curing. According to one special embodiment, the area of the rod that is to be adhered to the shoe is treated by, for example, sand blasting or laser scribing to provide a roughened surface for improved adhesion. FIG. 5 also illustrates the matching of alignment slot 521 of the isolation ring 524 with the alignment slot 533 of the shoe 526.

Figure 6A:
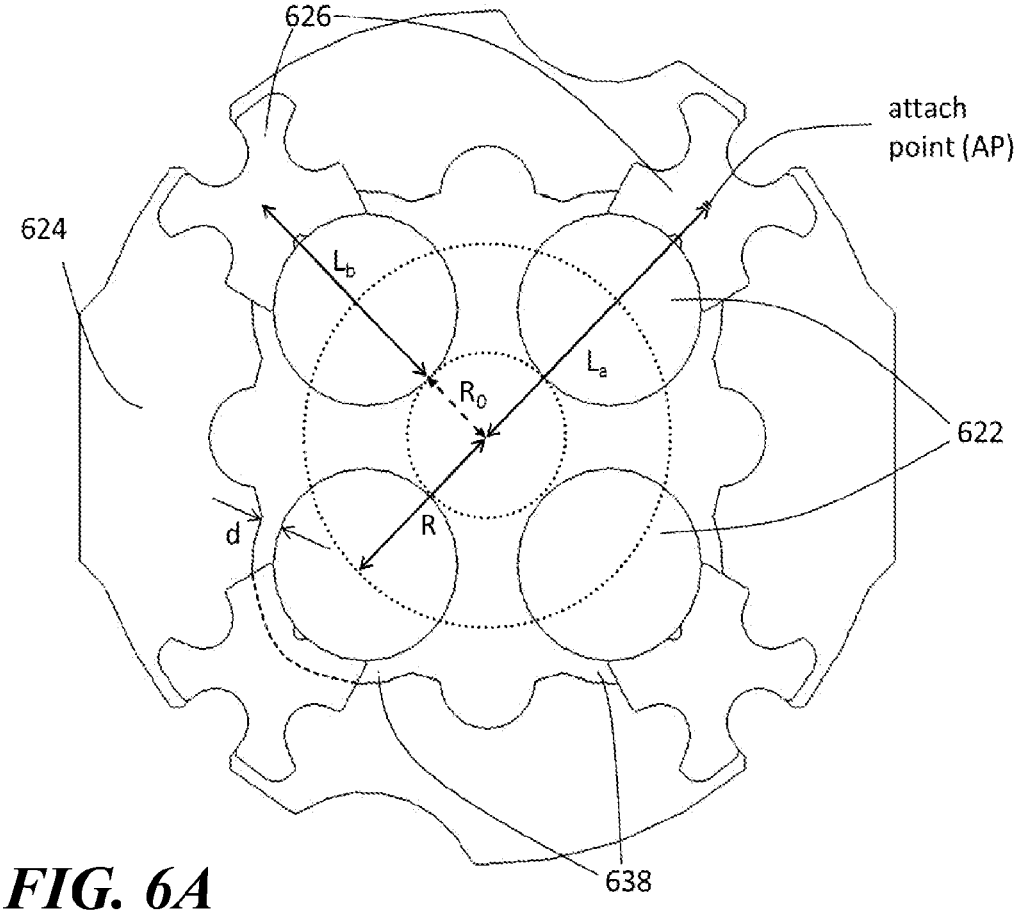
FIG. 6A illustrates the quadrupole mass analyzer from the side facing the shoes, according to an embodiment of the invention, whereas FIG. 6B, by way of example, illustrates schematically thermal expansion properties on the design shown in FIG. 6A.

FIG. 6A illustrates the quadrupole mass analyzer from the side facing the shoes. As seen, four rods 622 are precisely aligned such that each is positioned tangentially to an imaginary circle of radius R (dotted line) from the axis of the ion transport path. The quadrupole shown can be rotated in any angular amount about the axis of the ion transport path and precisely maintain its symmetry. As can be seen in FIG. 6A, the inner edge of the isolation ring 624 has a plurality of arcuate cuts 638, similar to the shoes. However, the arcuate cuts 638 are of larger diameter than the diameter of the rods, thus providing a setback of length d from the rods when the rods are properly aligned. The distance d to each rod need not to be accurate, which means that the design of the arcuate cut 638 need not be made accurate, thereby reducing cost and making it easier to fabricate the isolation rings. The setback d is maintained by the shoes 626 being adhered to the rods 622 and the insulation rings 624.

When assembled, the rods are electrically insulated from each other by the isolation rings. However, the rods are maintained in precise alignment so as to generate the required field for transporting the ions. The rods are coupled to power sources in pairs, such that the field generated by the rods forms the desired bandpass to transport ions of specific m/z ratio. As noted above, in quadrupole analyzers the rod spacing is an important parameter in determining the mass of an ion that is selected for transmission. Unless the RF voltage is adjusted to compensate for dimensional changes of the analyzer, the passed mass will drift as the assembly warms up or cools down. The required dimensional stability is stringent in order to maintain less than 0.1 amu change of a 1000 amu peak. Such mass stability requires less than 50 ppm change of $R_0$. Given that temperature changes of several degrees during startup of an instrument occur and that equilibrium times can be very long, on the order of hours, a low sensitivity to temperature is desirable. Most materials have expansion coefficients between 20 and 10 ppm/degree C. so only small temperature changes can be tolerated if $R_0$ has sensitivity on the same order. According to a feature of the invention, precise spacing of the rods is achieved regardless of thermal expansion.

According to embodiments of the invention, the radial thermal expansion of the ceramic ring is, at least in part, canceled by the expansion of the quadrupole rod diameter. This results in smaller changes in $R_0$ with temperature and improved mass stability. With certain combinations of ring and rod materials along with a suitable radius of attachment (the effective point where the shoe-rod pair is joined to the ceramic) the temperature sensitivity can be zero. Cancellation would result using the same ring and rod dimensions if the rods were made from, for instance, a 10 ppm/degree C. material like 410 stainless steel or Hastelloy® B (a nickel-molybdenum alloy).

Figure 6B:
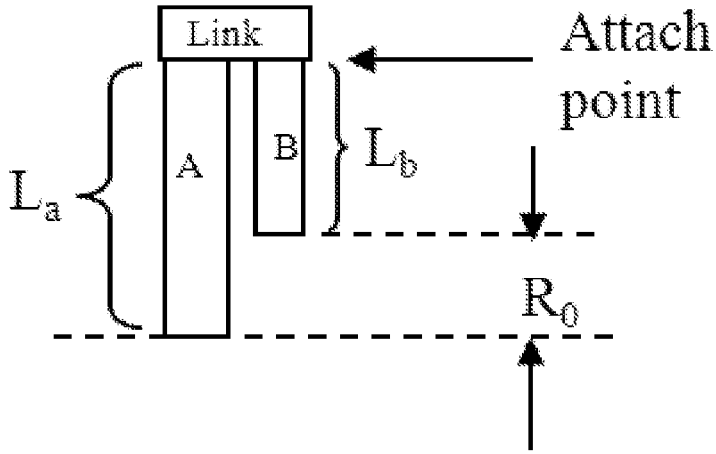

In order to cancel the effect of thermal expansion, according to an embodiment of the invention two materials of two different thermal coefficients are used (ring material and rod/shoe material). A simplified structure having this property is illustrated in FIG. 6B. Two bars, A and B, lengths $L_a$ and $L_b$ respectively, are joined by a common link, thus the distance $R_0$ is $L_a-L_b$. If the thermal expansion coefficient of each bar is $\alpha_a$ and $\alpha_b$, the length $R_0$ as function of temperature is $L_a(1+\alpha_a*\Delta T)-L_b(1+\alpha_b*\Delta T)$ if both bars experience the same temperature change. Since $R_0-\Delta R_0=(L_a+L_b)+L_a*\alpha_a*\Delta T-L_b*\alpha_b*\Delta T$ it follows that $\Delta R_0/\Delta T=L_a*\alpha_a-L_b*\alpha_b$. This means that an $R_0$ zero temperature coefficient requires $L_a/L_b=\alpha_b/\alpha_a$.

An example of how this feature can be implemented is illustrated in FIG. 6A. In the example of FIG. 6A the size and material of the isolation ring 624 and shoes 626 and their mutual attachment point, are selected as follows. The length $L_a$ is the distance from the center axis of the ceramic isolation ring 624 (usually also representing the ion transfer axis) to the attach point, AP, as illustrated by the arrow $L_a$. The length $L_b$ is the sum of the rod 622 diameter and the shoe 624 span to the same attach point AP. In this example it is assumed that the shoe and rod are of the same material or at least have a similar coefficient of thermal expansion. Using this relationship and the thermal expansion coefficient of the isolation ring and shoes, the size (for example radius) of the isolation ring and the location of the attachment point can be calculated. Shoes and rods, however, do not necessarily have to be made of materials having similar thermal expansion properties. In other embodiments rods and shoes could be made of materials with significantly different thermal expansion coefficients. For the aforementioned considerations to apply, then, the term $L_b(1+\alpha_b*\Delta T)$ would have to be replaced by a term such as $L_{b,composite}(1+\alpha_{b,composite}*\Delta T)=L_{b1}(1+\alpha_{b1}*\Delta T)+L_{b2}(1+\alpha_{b2}*\Delta T)$ where $\alpha_{b1}$ and $\alpha_{b2}$ would represent the different material coefficients of rods and shoes, and $L_{b1}$ and $L_{b2}$ the different (radial) lengths, respectively.

To give an example of properly choosing materials, a method for fabricating a multipole mass analyzer having thermal expansion compensation may comprise the steps of obtaining thermal expansion coefficients and diameter of rods forming the multipole mass analyzer, obtaining a plurality of attachment pieces and obtaining thermal expansion coefficients of the attachment pieces, obtaining a plurality of rings and obtaining thermal expansion coefficients of the rings, using the diameter and thermal coefficient of the rods calculating thermal expansion of the rods in a direction perpendicular to an ion transfer axis, calculating thermal expansion of the attachment pieces and adding the result to the thermal expansion of the rods, calculating thermal expansion of the rings, determining an attachment point on the ring defined by a point on the ring that exhibits thermal expansion complementary to the thermal expansion of the rods plus that of the attachment pieces, and connecting the attachment pieces to the rods and to the attachment points on the rings.

Figure 7:
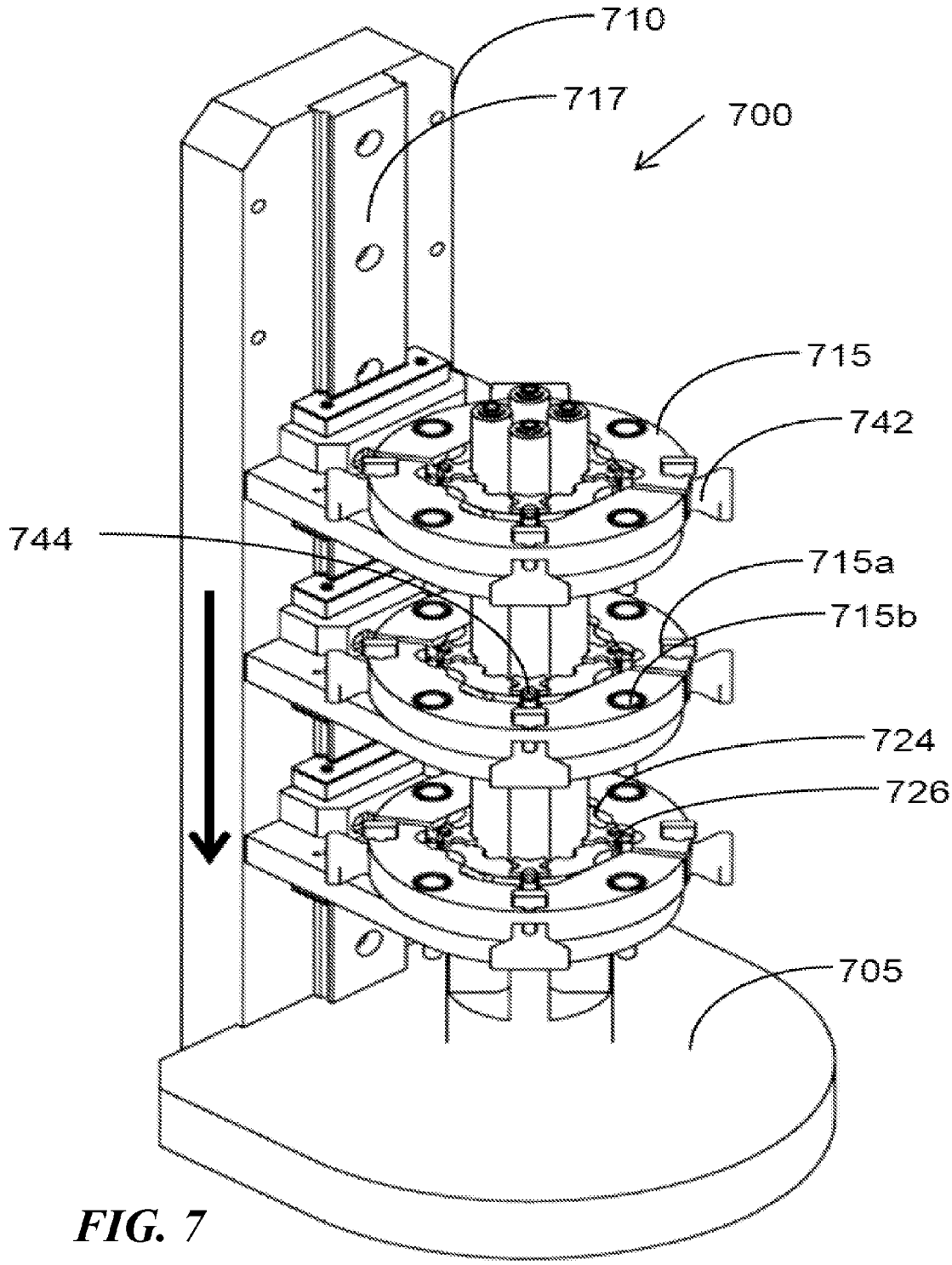
FIG. 7 illustrates a fixture according to an embodiment of the invention.

FIG. 7 illustrates a fixture 700 according to an embodiment of the invention, assisting the assembly of the multipole, in this example a quadrupole, with high precision even when the isolation rings and the shoes are not manufactured to high precision tolerances. The fixture 700 of FIG. 7 has a base 705 and a tower 710 attached to, or made integrally with the base. A plurality of isolation ring holders 715 are attached to the tower 710. In the specific example of FIG. 7, the holders 715 are slidably attached to the tower 710 via sliding track 717 to enable variable placement of the isolation rings along the mass analyzer and easy removal of the spacers and assembled mass analyzer once the adhesive cures. That is, when the assembly is completed and the adhesive cures, the holders can be lowered and the spacers removed, as indicated by the bold arrow in FIG. 7, thereby releasing the assembly. However, this is not necessary and in other embodiments the holders 715 can be permanently attached to the tower 710. In such a configuration the base or pedestal can be made to raise the quadrupole assembly to release it from the holders.

Also, in FIG. 7 three holders 715 are shown, as three isolation rings are used. If a different number of isolation rings are used, then a corresponding number of holders 715 should be used as well. That is, to assist in improved assembly, according to this embodiment all of the isolation rings are adhered to the rods at the same time. Therefore, the number of isolation ring holders should match the number of isolation rings that are to be adhered to the rods at the same time.

Each of the holders 715 has a plurality of spring-loaded plungers 742. The number of plungers 742 corresponds to the number of rods. When retracted, the plungers enable insertion of rods into the fixture 700. When released and extended by the load of the spring, the plunger urges the rod against the spacer 800, shown in FIG. 8. The spring loaded urging of the rods against the spacer 800 ensures precision alignment of the rods. The isolation rings 724 are seated within the respective holders 715, aligned by the alignment pins 744, which fit in alignment slots 321 in the isolation rings 724 and alignment slots 433 in shoes 726. Since the alignment of the rods is assured by the spring loaded plungers 742 urging the rods against spacer 800, the shoes can now be adhered to the rods and the isolation rings. Once the adhesive cures, the spacers 800 can be removed and the mass analyzer assembly can be removed from the fixture, while the bonding to the shoes and isolation rings maintains the alignment of the rods.

Figure 8:
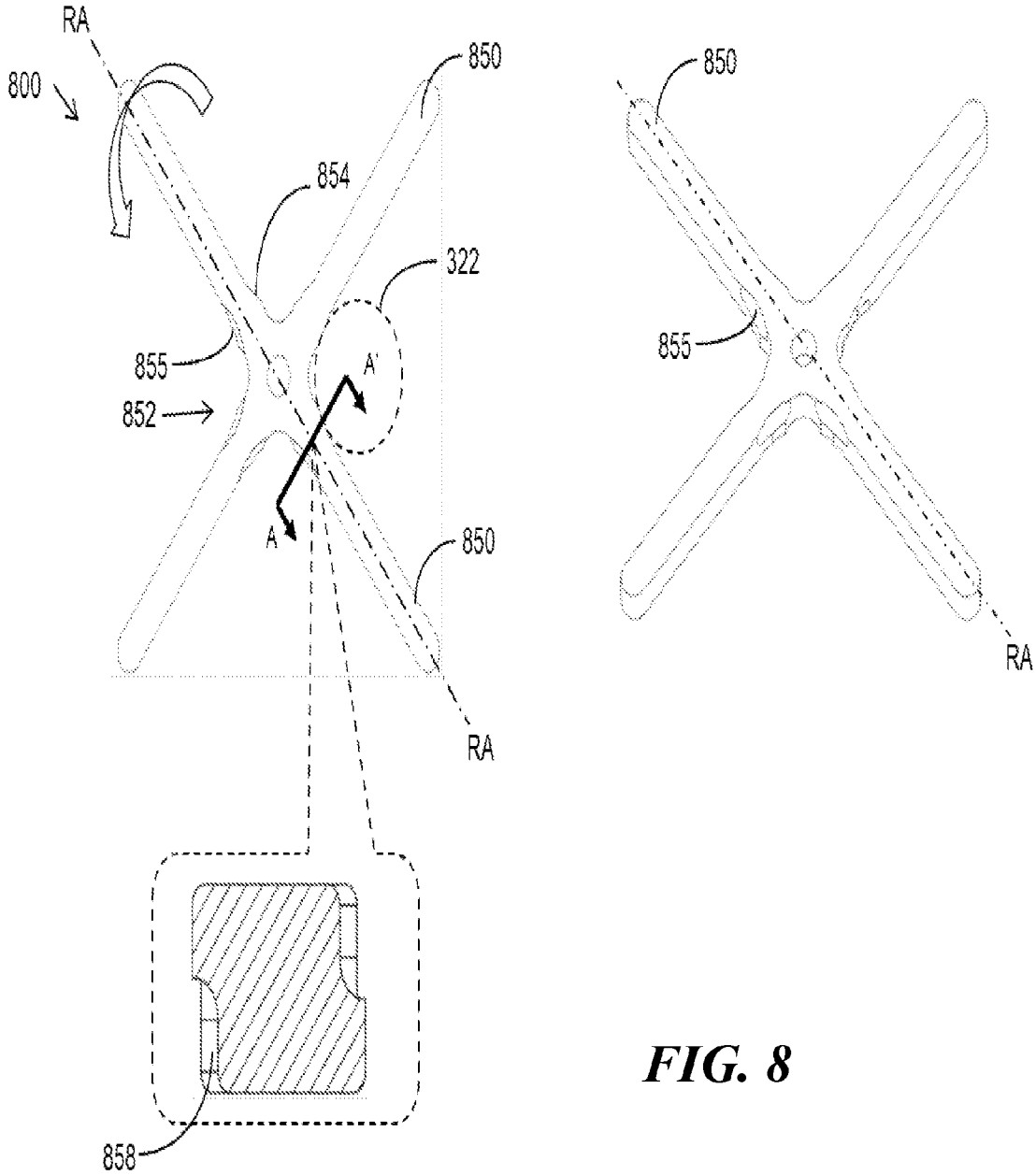
FIG. 8 is an illustration of a spacer according to an embodiment of the invention.

An embodiment of spacer 800 is shown in FIG. 8. The spacer by way of example is generally in the shape of a propeller, having a number of blades or arms corresponding to the number of rods. Since in the examples illustrated herein a quadrupole is fabricated, the spacer 800 of FIG. 8 has four arms 850. Each of the arms 850 has a nesting area 852 which may be structured to precisely nest the rod, in cooperation with the nesting area of the neighboring arm. In the example of FIG. 8, the nesting area 852 includes an indentation or dimple 854. The dimples 854 from adjacent arms touch the rod at only two tangential areas, as illustrated by the broken-line drawing of rod 322, thereby preventing scratching of the rod by the arm. The area of contact between arm and rod is confined to the space between adjacent rods, and thereby any surface modification due to contact forces will hardly affect the electromagnetic fields acting radially inward to the center of the multipole. The precise machining of the dimples assists in precise alignment and assembly of the mass analyzer. In the example of FIG. 8, each dimple includes a small arcuate cut 855 generally of the same diameter as the rod, such that the rod contacts only the arcuate cut 855. Also, since the spacer determines the final accuracy of the assembled mass analyzer, and since it may be used repeatedly to assemble many mass analyzers, in this example the spacer 800 is made of a high strength material, such as tungsten carbide. Of course, any other high strength materials may be used.

To enable easy removal of the spacers after curing of the adhesive, each of the arms of the spacer may have an "S" shape profile, as shown in the callout A-A' in FIG. 8. Notably, the S-shape is reversed along a rotational axis, as exemplified by line RA. As can be understood, in this example, the rotational axis passes through the center of the spacer, and designates a line along which the spacer is symmetrical if it could be folded. In this particular example, the line could be called a line of folding symmetry. Stating it another way, if the spacer is to be rotated 180° about the axis RA, it will assume the same configuration as shown in FIG. 8.

On one side of line RA the cutout 858 of the S-shape is on the top while on the other side the cutout 858 of the S-shape is on the bottom. Easy removal of the spacer is achieved by simply rotating the spacer along the rotational axis, as shown by the curved arrow in FIG. 8. Consequently, no scratching of the rods occurs during the removal, since the spacer is not removed by sliding or linearly extracting the spacer as is done in the prior art. Also, since the spacer is not removed by sliding, no lubrication is needed and no thermal contraction is needed for the removal of the spacer, as was required in the prior art.

During the alignment the rods 322 are neatly settled in the effective nesting space between two adjacent arms 850 of the spacer 800 (in other words, the arc space between two adjacent arms 850) where the spacer 800 is aligned in a plane perpendicular to a plane of extension of the rods. The outer rod contour contacts nesting areas 852 at the arms 850 of the spacer 800 just at two tangential points (or small areas having finite dimension) which designate a region of largest effective arm width when the spacer 800 is aligned perpendicular to the rod axis. When tightly urged against the nesting areas 852 of the arms 850, the rods 322 are aligned such that the spacing between two adjacent rods corresponds to this largest effective arm width to high precision. When this precise positioning and alignment configuration is fixed by the adhesive bonding, upon rotation of the spacer 800 around the rotational axis RA, the dimples 854 or indentations shown rotate into a position directly facing the fixed rods and, due to their setback design compared to the contour of the largest effective arm width (see call-out), thereby creating a gap between the nesting areas 852 (now rotated away) and the outer rod contour. In this manner, the arms 850 of the spacer 800 are released from contact with the fixed rods 322, so that after a rotation of about 90° the arms 850 extend in a plane passing through spacings between the rods and can be removed by simply pulling it out laterally without any further interaction with the rods.

According to one embodiment of the invention, each holder 715 has a pocket for one spacer 800. Once the adhesive cures, each holder 715 is lowered on track 717, so that the spacer 800 can be rotated and removed. Alternatively, the assembly could be raised a bit so as to release spacers 800 from their pocket, and then the spacer is rotated and removed from the assembly.

Figure 9:
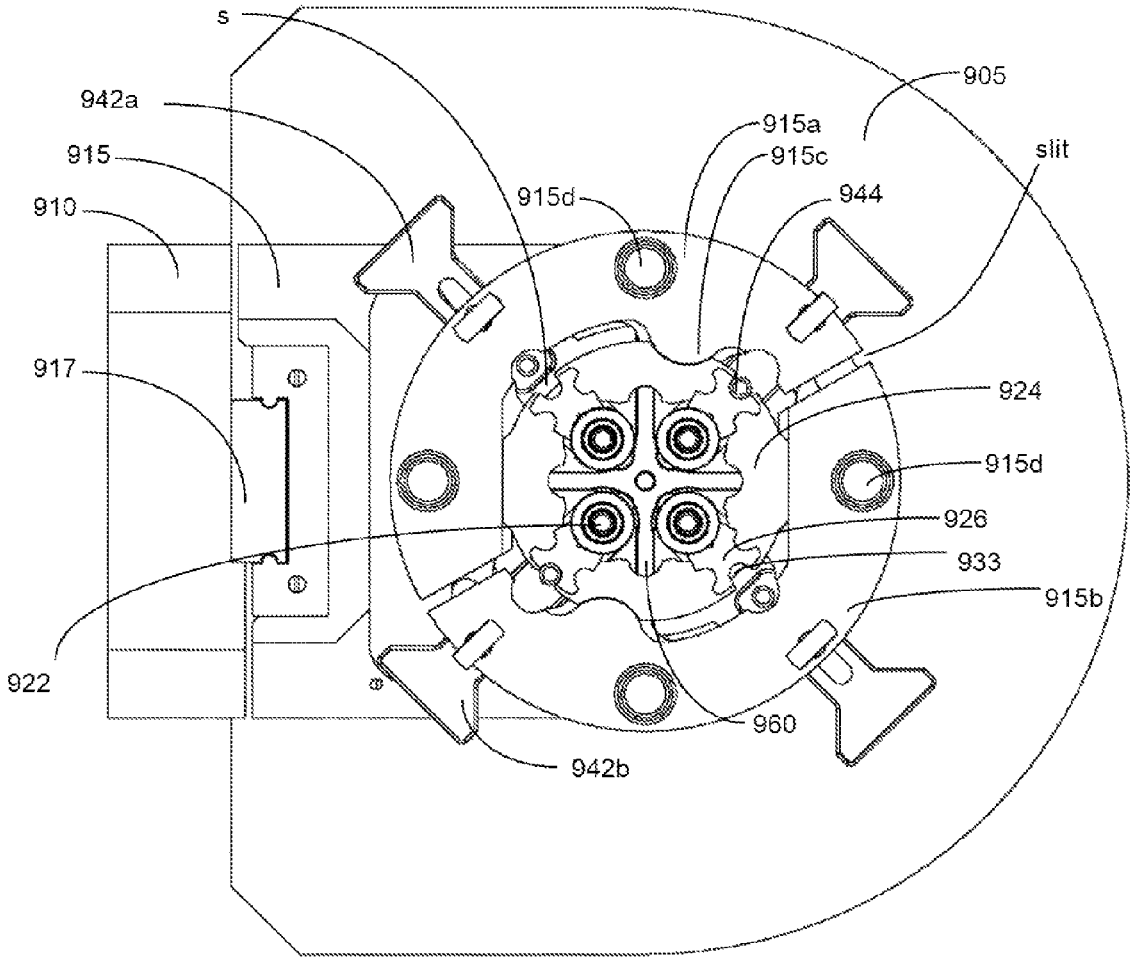
FIG. 9 is a top view of a fixture according to an embodiment of the invention.

FIG. 9 is a top elevation view of the fixture according to an embodiment of the invention. As explained with respect to FIG. 7, the fixture includes a base 905, a tower 910, and a sliding track 917, upon which the holders or stages 915 are slidingly fitted. Holders 915 are fitted with spring loaded plungers 942 and alignment pins 944, which are designed to fit the alignment notches of the isolation rings and shoes. In the particular example of FIG. 9, the alignment pins 944 are affixed to the end of the plungers, but other arrangements of fitting the alignment rods may be implemented.

In the particular example of FIG. 9, each of the stages 915 has two half rings 915*a* and 915*b* (separated by a slit) positioned on top of the holder 915. The half rings 915*a* and 915*b* have two machined steps 915*c*, upon which the ceramic isolation ring 924 rests. Each of the half rings 915*a* and 915*be* is held in place by removable pins 915*d*, two each in this example. This arrangement assists in removal of the bonded assembly from the fixture. To remove the bonded quadrupole assembly, the pins 915*d* are removed, which in turn allows removal of the half rings 915*a* and 915*b*. This releases the isolation rings 924. Stage 915 then can be lowered so that the spacer can be rotated and removed. Then the entire assembly can be removed from the fixture. Other possible embodiments could have split stages that open up like horizontal clamps or ceramic rings that would allow clearance of the stages by rotating the quadrupole assembly about its long axis to clear the support steps.

In FIG. 9 the fixture is illustrated with the four rods 922 in place, fitted about the spacer 960. Also shown are the top insulating ring 924 and the four shoes 926 to be adhered to the rods and the top insulating ring. In FIG. 9, plunger 942*a* is illustrated in the retracted position, that is, not urging the rod against the spacer 960 (also indicated by the space "s"), while plunger 942*b* is illustrated in the extended position, urging the rod against the spacer 960. Notably, in this particular example, the alignment pins 944 are provided on the engaging end of the plungers 942. When the plungers are released, the spring action urges the alignment pin into the alignment notch 933 of the shoes, thereby urging the shoes against the respective rod 922. As the shoes 926 are urged against the rods, they urge the rods 922 against the spacer 960, thereby ensuring proper alignment of the rods.

As can be appreciated from the above description, embodiments of the invention enable a rather easy manufacturing, since the isolation rings and the shoes can be manufactured with loosened tolerance levels. The spacer is the only part that requires high level of precision, but it can be reused many times, so that the production costs can be spread over many assemblies. The fixture enables high speed of assembly of the mass analyzer and the resulting mass analyzer has an open structure that maximizes gas conductance.

Figure 10:
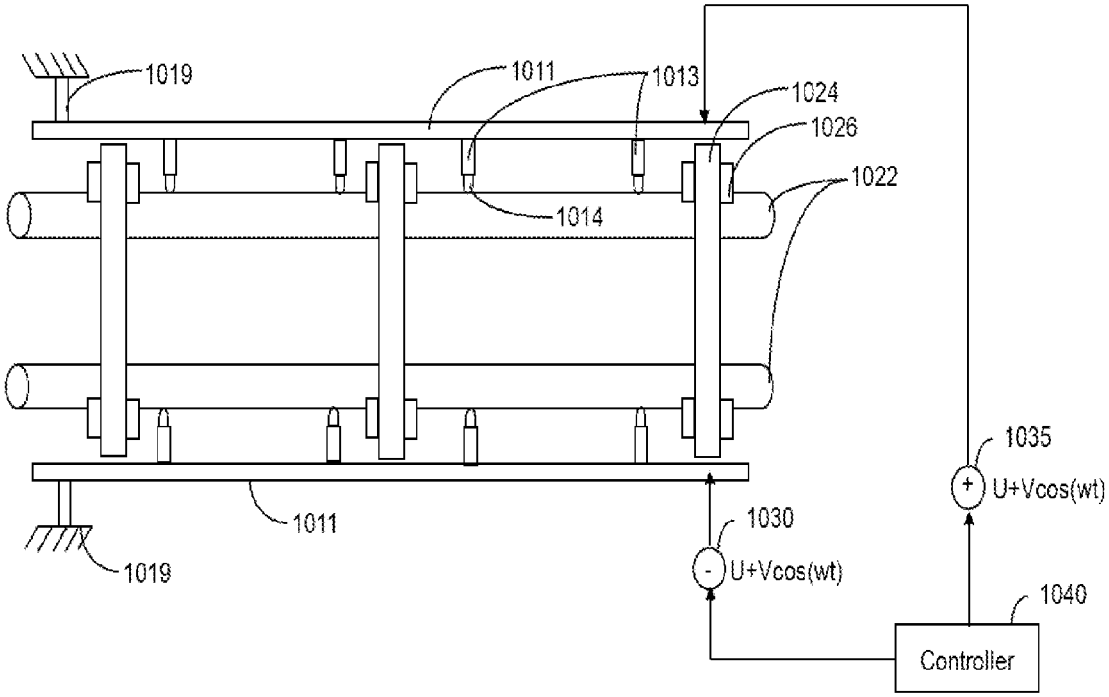
FIG. 10 is a side view illustrating electrical connections according to an embodiment of the invention.

FIG. 10 is a side view illustrating electrical connections according to an embodiment of the invention. Rods 1022 are bonded to the shoes 1026, which are bonded to the isolation rings 1024, as in the previous embodiments with the exception that shoes are attached to the isolation rings on both faces thereof, thereby reducing impairment due to thermal stress. The electrical signal from sources 1030 and 1035 is applied to circuit boards (PCB) 1011 that, as exemplified by anchor points 1019, may be attached to a solid part of the spectrometer. The attachment of the PCB should be in such a way that thermal expansion of the PCB does not apply forces on the isolation rings. In this embodiment, the PCB is attached to a vacuum manifold (not shown), while sliding contact with reference surfaces on the manifold supports the rings. This effectively isolates the quadrupole assembly from thermal expansion effects of the PCB, and the manifold. Pogo pins 1013 are electrically connected to the circuit board to receive the respective signal. The retractable contact 1014 of the pogo pins contact the corresponding rod and thereby delivers the signal to the rods. This arrangement eliminates any need for wiring inside the spectrometer, and also dispenses with the need to provide conductive attachments between rods and shoes for supplying operating voltages. Instead, the rods can be supplied via the pogo pins individually.

The above description relates to a specific embodiment of the invention; however, the invention can be implemented using other embodiments to achieve the same improvements and features. Some of these improvements and features are summarized as follows. According to embodiments of the invention, a simple rod geometry is implemented. This leads to fewer machining operations, with no tapped holes for mounting or electrical connections. The symmetric design of the cylindrical rods minimizes distortion and prevents rotational misalignment. Therefore, no off axis tapped holes are required. The cylindrical rods shown in the examples have generally a round circular cross section. This is not to be construed restrictive but rather owed to the ease of illustration. Certain aspects of the invention are also applicable with rods having a non-symmetric outer contour such as a hyperbolic outer contour, or with hollow rods being constituted by four sheath electrode segments. Also, in some embodiments an integral guide rod AC coupling is provided through ceramic spacer mounted with on axis screw on ends. In embodiments of the invention all of the electrical connections are made through spring contacts. Since in such embodiments no wire connections are made to the multipole or its guide rods, it results in reproducible capacitance and freedom from accidental shorting.

As explained above, using embodiments of the invention one may use non-precision ceramic isolation support rings. Such rings may be laser or jet cut from a lower cost thin plate stock. Also, according to embodiments of the invention the isolation rings are not attached directly to the rods, but are rather coupled to the rods via intermediate bonding shoes, which can be made of metal. The bonding shoes may have cross ribs to add surface area and enhance bonding surface with minimal contact to the rods. The bonding shoes may be made using wire EDM (electric discharge machining), thereby obtaining controlled surface roughness and bond layer. The shoes are attached to the rod using thin film adhesive bonding, thereby minimizing thermal expansion contribution to the rod spacing and providing a low thermal stress bond process. The shoes are bonded to the isolation rings on the side surface to provide a large ceramic-metal bond area for reliability.

According to embodiments of the invention, a bonding fixture is used to assemble the mass analyzer. This enables easy scale-up of production and makes automation feasible. Since the spacers provide the required accuracy, the rods are the only high precision parts in the finished mass analyzer assembly. The precision spacers are reusable, thereby spreading the cost over many assemblies. The shoes attach to the rods at a non-critical area, thereby avoiding distortion of the electrical field. Also, the fixture may include movable isolation ring holders, to ease removal of the completed assembly.

It should be understood that processes and techniques described herein are not inherently related to any particular apparatus and may be implemented by any suitable combination of components. Further, various types of general purpose devices may be used in accordance with the teachings described herein. It may also prove advantageous to construct specialized apparatus to perform the method steps described herein.

The present invention has been described in relation to particular examples, which are intended in all respects to be illustrative rather than restrictive. Those skilled in the art will appreciate that many different combinations of hardware, software, and firmware will be suitable for practicing the present invention. Moreover, other implementations of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A multipole assembly, comprising:

(a) a plurality of conductive rods;

(b) a plurality of shoes, each shoe adhesively attached on one of its edges to a corresponding rod; and (c) a plurality of isolation rings, each isolation ring attached on at least one of its sides to a subset of the plurality of shoes.

2. The assembly of claim 1, wherein the shoes are directly adhesively attached to the isolation rings.

3. The assembly of claim 1, wherein the shoes are adhesively attached to the conductive rods by means of epoxy resin.

4. The assembly of claim 1, wherein the edges of the shoes comprise a slot for taking up excess adhesive.

5. The assembly of claim 1, wherein each of the rods comprises a plurality of roughened areas corresponding to locations where the shoes are attached to the rod.

6. The assembly of claim 5, wherein the roughened areas comprise laser scribed areas.

7. The assembly of claim 1, wherein the shoes are essentially disk-shaped and comprise an arcuate cut of a diameter similar to a diameter of the rods.

8. The assembly of claim 7, wherein the arcuate cut has a textured surface.

9. The assembly of claim 8, wherein the textured surface comprises one of sand blasted surface, laser scribed surface, serrated surface, ribbed surface, and ridged surface.

10. The assembly of claim 1, wherein the shoes comprise an alignment notch.

11. The assembly of claim 1, wherein the isolation rings comprise an arcuate cut of a radius larger than a radius of the rods.

12. The assembly of claim 1, wherein the isolation rings comprise a plurality of alignment notches.

13. The assembly of claim 1, wherein the plurality of rods comprises n rods, the plurality of isolation rings comprises m isolation rings, and the plurality of shoes comprises n times m, n*m, shoes.

14. The assembly of claim 13, wherein n=4 and m=3.

15. The assembly of claim 1, wherein shoes are attached to the isolation rings on both faces thereof at essentially a same circumferential position.

16. The assembly of claim 1, wherein the conductive rods define an ion transfer axis and an inner radius, $R_0$, and materials for the conductive rods, the shoes and the isolation rings are chosen such that the inner radius is essentially invariant with change in temperature.

17. The assembly of claim 1, wherein the conductive rods define an ion transfer axis and an inner radius, $R_0$, and a radial distance of a point of attachment between shoes and isolation rings from the ion transfer axis is selected such that, in view of thermal expansion properties of materials for the conductive rods, shoes and isolation rings, the inner radius is essentially invariant with change in temperature.

18. A method for fabricating a multipole assembly, comprising:

(a) inserting a plurality of conductive rods into a fixture;

(b) inserting at least one precision-made spacer in between the plurality of rods;

(c) urging the rods against the spacers to obtain precise alignment of the rods;

(d) adhesively attaching a plurality of shoes onto the rods, each shoe having a plurality of edges of which one edge is adhesively attached to a corresponding rod;

(e) attaching a plurality of isolation rings onto the shoes, each isolation ring having a plurality of sides of which at least one side is attached to a subset of the plurality of shoes; and (f) after the plurality of shoes are adhesively attached to the rods and the plurality of isolation rings are attached to the shoes, removing the spacers and releasing the rods from the fixture.

19. The method of claim 18, wherein step (e) comprises adhesively attaching the isolation rings directly onto the shoes.

20. The method of claim 18, further comprising roughening a plurality of areas on each of the rods prior to step (d), the plurality of areas corresponding to the location of bonding of the shoes.

21. The method of claim 18, further comprising surface treating edges of the plurality of shoes prior to step (d).

22. The method of claim 21, wherein surface treating comprises one of sand blasting the surface, laser scribing the surface, and cutting the surface to generate serrated surface, ribbed surface, or ridged surface.

23. A spacer for fabricating a multipole assembly having a plurality of rods, the spacer comprising arms extending from a cross-point with two arms extending along a rotational axis, the spacer also comprising nesting areas between adjacent arms with effective nesting space for receiving and aligning rods, wherein the cross section of the arms in the nesting areas is configured such that by rotating the spacer around the rotational axis the effective nesting space is increased.

24. The spacer of claim 23, wherein the cross section of the arms is essentially rectangular or square with dimples in the nesting areas.

25. The spacer of claim 23, wherein each arm comprises a section having an S-shaped cross-section, and wherein the S-shaped cross section on one side of the rotational axis is oriented opposite that of the S-shape cross section on the other side of the rotational axis.

26. The spacer of claim 23, wherein the nesting areas have a shape generally adapted to a diameter of the rods.

27. The spacer of claim 23, wherein the nesting areas comprise a flattened surface in a region of contact between rod and arm.

28. The spacer of claim 23, comprising tungsten carbide.

29. A method for fabricating a multipole assembly, comprising:

(a) inserting a plurality of conductive rods into a fixture;

(b) inserting at least one precision-made spacer in between the plurality of rods, the spacer having arms a cross section of which determines an effective width which essentially defines a spacing between two adjacent conductive rods;

(c) urging the rods against the spacer to obtain precise alignment of the rods;

(d) attaching a plurality of isolation rings onto the rods;

(e) removing the spacer by means of a rotational motion along a rotational axis running through spacings between the rods, thereby essentially reducing the effective width of the arms and disengaging the spacer from the rods; and (f) releasing the rods from the fixture.

30. A fixture for fabricating a multipole assembly having a plurality of conductive rods, comprising:

(a) a support; and (b) a plurality of isolation ring holders attached to the support, the isolation ring holders having recesses for receiving spacers which assist in the alignment of the rods, and each holder having a plurality of plungers for urging the rods against the spacers during assembly of the rods.

31. The fixture of claim 30, wherein the support comprises a base, and a tower that is one of attached to and made integrally with the base.

32. The fixture of claim 30, wherein the holders are slidably attached to the support via a sliding track.

33. The fixture of claim 30, wherein the holders have alignment pins for aligning isolation rings and shoes during assembly of the rods.

34. The fixture of claim 33, wherein the alignment pins are attached to ends of the plungers.

35. The fixture of claim 30, wherein the recesses for the spacers have a shape of pockets.

36. The fixture of claim 30, wherein the plungers are spring-loaded.

37. The fixture of claim 30, wherein a number of plungers on each holder corresponds to a number of rods to be assembled.

38. The fixture of claim 30, wherein the holders comprise two half rings, the half rings having two machined steps for supporting an isolation ring and being held in place by removable pins.

* * * * *